US009540993B2

(12) United States Patent
Enriquez et al.

(10) Patent No.: US 9,540,993 B2
(45) Date of Patent: Jan. 10, 2017

(54) SINGLE STEP STARTING SYSTEM

(71) Applicant: HUSQVARNA AB, Huskvarna (SE)

(72) Inventors: Ruben Enriquez, Huntersville, NC (US); Robert Schriever, Charlotte, NC (US)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/035,896

(22) PCT Filed: Nov. 22, 2013

(86) PCT No.: PCT/US2013/071385

§ 371 (c)(1),
(2) Date: May 11, 2016

(87) PCT Pub. No.: WO2015/076815

PCT Pub. Date: May 28, 2015

(65) Prior Publication Data

US 2016/0265429 A1 Sep. 15, 2016

(51) Int. Cl.

| | |
|---|---|
| ***F02M 1/02*** | (2006.01) |
| ***F02B 63/02*** | (2006.01) |
| ***F02P 5/04*** | (2006.01) |
| ***F02D 41/06*** | (2006.01) |

(52) U.S. Cl.

CPC ..... *F02B 63/02* (2013.01); *F02D 41/067* (2013.01); *F02P 5/04* (2013.01); *F02D 2400/06* (2013.01); *F02M 1/02* (2013.01)

(58) Field of Classification Search

CPC F02B 63/02; F02D 2400/06; F02D 2700/022; F02M 1/00; F02M 1/02; F02M 1/04

See application file for complete search history.

(56) References Cited

U.S. PATENT DOCUMENTS

| | | |
|---|---|---|
| 3,965,224 A | 6/1976 | Freismuth |
| 5,611,312 A | 3/1997 | Swanson et al. |

(Continued)

OTHER PUBLICATIONS

International Search Report and Written Opinion of International Application No. PCT/US2013/071385 mailed Apr. 14, 2014, all enclosed pages cited.

(Continued)

*Primary Examiner* — Thomas Moulis

(74) *Attorney, Agent, or Firm* — Nelson Mullins Riley & Scarborough LLP

(57) ABSTRACT

A hand-held power tool may include a housing, a power unit disposed within the housing and configured to operate at least in part in response to actuation of a trigger, a working assembly powered responsive to operation of the power unit, and an activation lever having an integrated lockout member. The activation lever may selectively engage a first fuel enrichment mode associated with startup of the power unit in a first range of ambient temperatures and a second fuel enrichment mode associated with startup of the power unit in a second range of ambient temperatures based on a position of the activation lever. Selective engagement of the first fuel enrichment mode or the second fuel enrichment mode may be enabled responsive to actuation of at least the lockout member and positioning of the activation lever.

17 Claims, 8 Drawing Sheets

(56) References Cited

U.S. PATENT DOCUMENTS

| | | | | |
|---|---|---|---|---|
| 5,842,277 | A * | 12/1998 | Haberlein | A01G 3/062 173/171 |
| 5,927,241 | A * | 7/1999 | Dahlberg | F02D 11/02 123/179.18 |
| 6,135,428 | A * | 10/2000 | Schliemann | B27B 17/00 261/35 |
| 6,427,647 | B1 | 8/2002 | Galka et al. | |
| 6,871,623 | B2 | 3/2005 | Ohsawa et al. | |
| 7,201,144 | B2 * | 4/2007 | Yuasa | F02D 11/02 123/396 |
| 7,427,057 | B1 | 9/2008 | Kampman et al. | |
| 7,611,131 | B2 * | 11/2009 | Engman | F02D 9/02 261/64.1 |
| 8,490,289 | B2 * | 7/2013 | Nystrom | B27B 17/0008 173/70 |
| 8,739,894 | B2 * | 6/2014 | Schlauch | B25F 5/02 123/179.18 |
| 9,074,535 | B1 * | 7/2015 | Huibregtse | F02M 3/06 |
| 2010/0237516 | A1 * | 9/2010 | Kern | F02M 1/02 261/64.6 |
| 2012/0318236 | A1 * | 12/2012 | Kullik | F02M 1/02 123/437 |
| 2013/0206093 | A1 | 8/2013 | Visuri et al. | |
| 2014/0352660 | A1 * | 12/2014 | Kurzenberger | F02D 29/00 123/400 |
| 2016/0177877 | A1 * | 6/2016 | Ottosson | F02B 25/22 261/43 |

OTHER PUBLICATIONS

Chapter II International Preliminary Report on Patentability of International Application No. PCT/US2013/071385 mailer Jan. 20, 2016, all enclosed pages cited.

* cited by examiner

C-C

SINGLE STEP STARTING SYSTEM

TECHNICAL FIELD

Example embodiments generally relate to hand held power equipment and, more particularly, relate to a starting mechanism for a chainsaw.

BACKGROUND

Chainsaws are commonly used in both commercial and private settings to cut timber or perform other rigorous cutting operations. Because chainsaws are typically employed in outdoor environments, and the work they are employed to perform often inherently generates debris, chainsaws are typically relatively robust hand held machines. They can be powered by gasoline engines or electric motors (e.g., via batteries or wired connections) to turn a chain around a bar at relatively high speeds. The chain includes cutting teeth that engage lumber or another medium in order to cut the medium as the teeth are passed over a surface of the medium at high speed.

Given that the chainsaw is expected to operate outdoors, it can be further expected that the chainsaw is likely to operate in different ambient temperatures. Since many chainsaws that are powered by gasoline engines employ some form of carburetor that may employ a fuel enrichment system, it can be appreciated that starting may be difficult if the weather is very cold. Moreover, it may further be appreciated that manipulation of the fuel enrichment system might be thought of as a way to improve the ability to start the chainsaw.

BRIEF SUMMARY OF SOME EXAMPLES

Some example embodiments may provide a relatively easy way to start and operate a power tool such as a chainsaw in different ambient temperature environments. In this regard, some example embodiments may provide for a relatively simple way for an operator to select different enrichment conditions based on current ambient temperatures. Accordingly, improved starting of the chainsaw or power tool may be facilitated.

In one example embodiment, a hand-held power tool is provided. The hand-held power tool may include a housing, a power unit disposed within the housing and configured to operate at least in part in response to actuation of a trigger, a working assembly powered responsive to operation of the power unit, and an activation lever having an integrated lockout member. The activation lever may selectively engage a first fuel enrichment mode associated with startup of the power unit in a first range of ambient temperatures and a second fuel enrichment mode associated with startup of the power unit in a second range of ambient temperatures based on a position of the activation lever. Selective engagement of the first fuel enrichment mode or the second fuel enrichment mode may be enabled responsive to actuation of at least the lockout member and positioning of the activation lever.

In another example embodiment, a fuel enrichment assembly for a hand-held power tool is provided. The hand-held power tool may include a housing, a power unit disposed within the housing and configured to operate at least in part in response to actuation of a trigger, and a working assembly powered responsive to operation of the power unit. The fuel enrichment assembly may include an activation lever and a lockout member integrated therewith.

The activation lever may selectively engage a first fuel enrichment mode associated with startup of the power unit in a first range of ambient temperatures and a second fuel enrichment mode associated with startup of the power unit in a second range of ambient temperatures based on a position of the activation lever. Selective engagement of the first fuel enrichment mode or the second fuel enrichment mode may be enabled responsive to actuation of at least the lockout member and positioning of the activation lever.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 illustrates a perspective view of a chainsaw according to an example embodiment;

FIG. 2, which includes FIGS. 2A and 2B, illustrates a throttle valve that may be provided along with a choke valve in an intake passage of a carburetor in accordance with an example embodiment;

DETAILED DESCRIPTION

Figure 1:
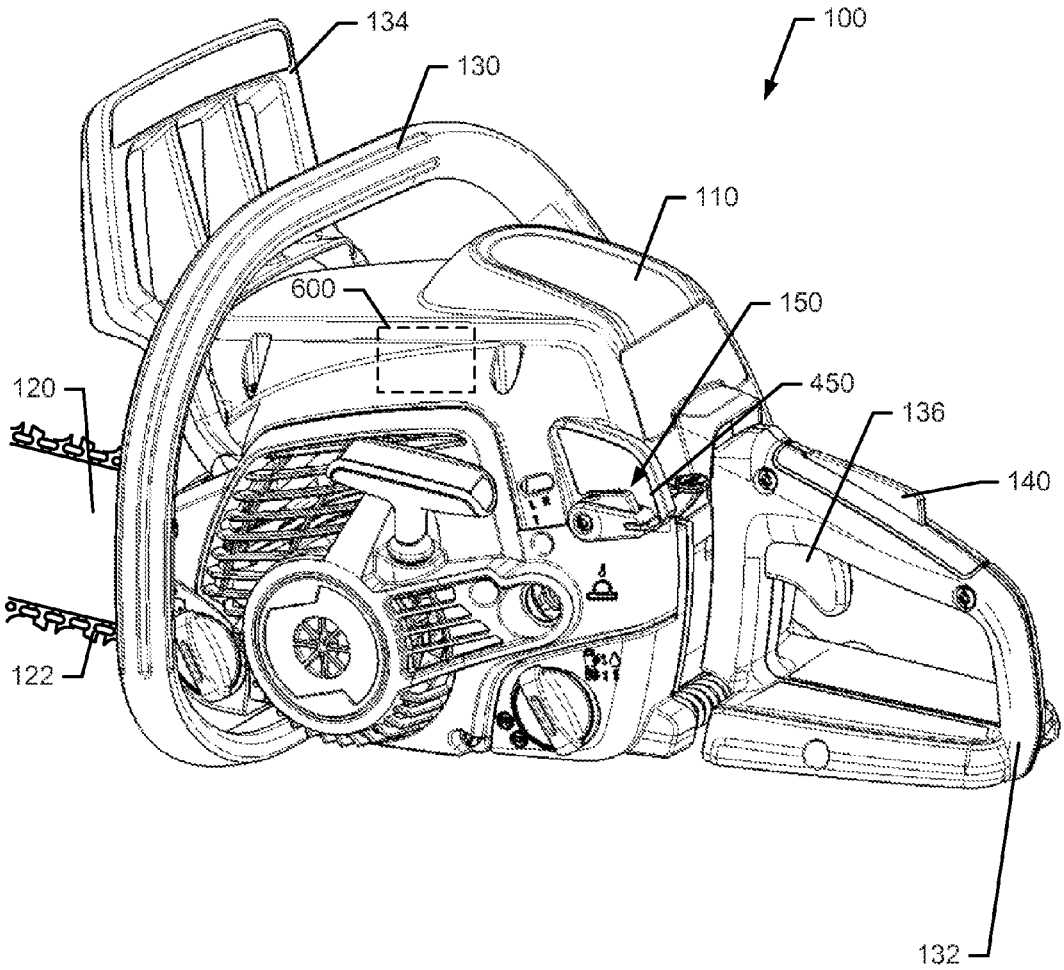

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may provide for a hand-held power tool (e.g., a chainsaw) that can be more easily started in different weather conditions by enabling the operator to more easily (and intuitively) set proper fuel enrichment conditions for starting over a wide range of ambient temperatures. In this regard, some example embodiments may provide an activation lever that may include an integrated lockout member to enable operators to selectively engage a first fuel enrichment mode associated with startup of the power unit in a first range of ambient temperatures or a second fuel enrichment mode associated with startup of the power unit in a second range of ambient temperatures based on the positioning of the activation lever. The lockout member may be required to be activated or actuated before the activation lever can be moved out of a normal operating position so that a single selector can provide enhanced control over starting conditions, but the single selector may include a two-step process for movement of the selector. The two-step process may be useful for increasing operator awareness, improving safety, meeting standards, or other purposes.

FIG. 1 illustrates a perspective view of a chainsaw 100 according to an example embodiment. It should be appreciated that the chainsaw 100 is merely one example of power equipment that includes a working assembly (i.e., the cutting components of the chainsaw 100) that may benefit from a single step starting system of an example embodiment. Thus, example embodiments could also be practiced in connection with some other power equipment that may include working assemblies of different types.

As shown in FIG. 1, the chainsaw 100 may include a housing 110 inside which a power unit (e.g., an engine or motor) is housed. In some embodiments, the power unit may be an internal combustion engine. Furthermore, in some embodiments, the power unit may power a working assembly of the chainsaw 100. The chainsaw 100 may further include a guide bar 120 that is attached to the housing 110 along one side thereof. A chain 122 may be driven around the guide bar 120 responsive to operation of the power unit in order to enable the chainsaw 100 to cut lumber or other materials. The guide bar 120 and the chain 122 may form the working assembly of the chainsaw 100.

The chainsaw 100 may include a front handle 130 and a rear handle 132. A chain brake and front hand guard 134 may be positioned forward of the front handle 130 to stop the movement of the chain 122 in the event of a kickback. In an example embodiment, the hand guard 134 may be tripped by rotating forward in response to contact with a portion of the arm (e.g., the hand/wrist) of the operator of the chainsaw 100. In some cases, the hand guard 134 may also be tripped in response to detection of inertial measurements indicative of a kickback.

The rear handle 132 may include a trigger 136 to facilitate operation of the power unit relative to turning the working assembly when the trigger 136 is actuated. In this regard, for example, when the trigger 136 is actuated (e.g., depressed), the rotating forces generated by the power unit may be coupled to the chain 122 either directly or indirectly. The term "trigger," as used herein, should be understood to represent any actuator that is capable of being operated by a hand or finger of the user. Thus, the trigger 136 may represent a button, switch, or other such component that can be actuated by a hand or portion thereof. In some cases, the trigger 136 may be locked or inoperable until another actuator 140 is depressed to indicate presence of the operators hand firmly on the rear handle 132 so that the trigger 136 cannot be accidentally actuated.

Some power units may employ a clutch to provide operable coupling of the power unit to a sprocket that turns the chain 122. In some cases (e.g., for a gasoline engine), if the trigger 136 is released, the engine may idle and application of power from the power unit to turn the chain 122 may be stopped. The housing 110 may include a fuel tank for providing fuel to the power unit. The housing 110 may also include or at least partially define an oil reservoir, access to which may be provided to allow the operator to pour oil into the oil reservoir. The oil in the oil reservoir may be used to lubricate the chain 122 as the chain 122 is turned.

As can be appreciated from the description above, actuation of the trigger 136 may initiate movement of the chain 122 around the guide bar 120. For power units that employ gasoline or petrol engines, the engine may operate in an idle state after starting of the engine until the trigger 136 is pressed. The idle state may represent a condition during which the engine operates at a lower RPM to sustain continuous operation of the engine and maintain the engine in a ready state to respond to actuation of the trigger 136 to increase RPM and turn the chain 122 for cutting, e.g., via engagement of a clutch.

In an example embodiment, the power unit may be an internal combustion (IC) engine. Internal combustion engines commonly control the air/fuel (A/F) ratio as a means by which to achieve a satisfactory combination of low fuel consumption, low exhaust emissions, good running performance and high efficiency. In many cases, maintaining the A/F-ratio is accomplished by controlling operation of a fuel supply system that may employ, for example, a carburetor or a fuel injection system. In some embodiments, the engine may be a crank case scavenged engine in which, for example, a mixture of air and fuel is regulated for provision into the engine crank house via the fuel supply system. From the crank house, the mixture may travel through one or several scavenging passages up to an engine combustion chamber where a spark plug ignites the compressed air-fuel mixture.

Figure 2B:
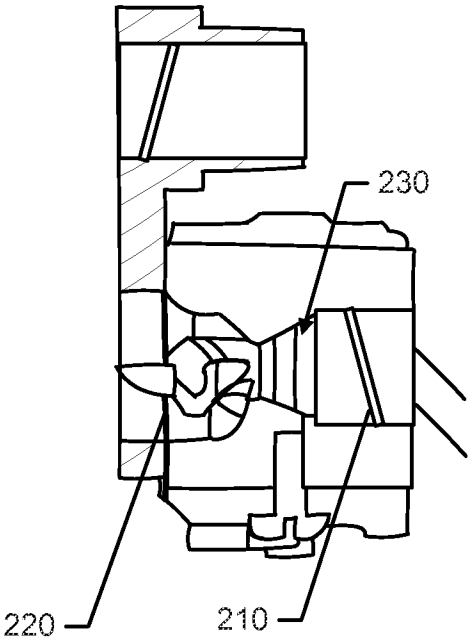
Figure 2A:
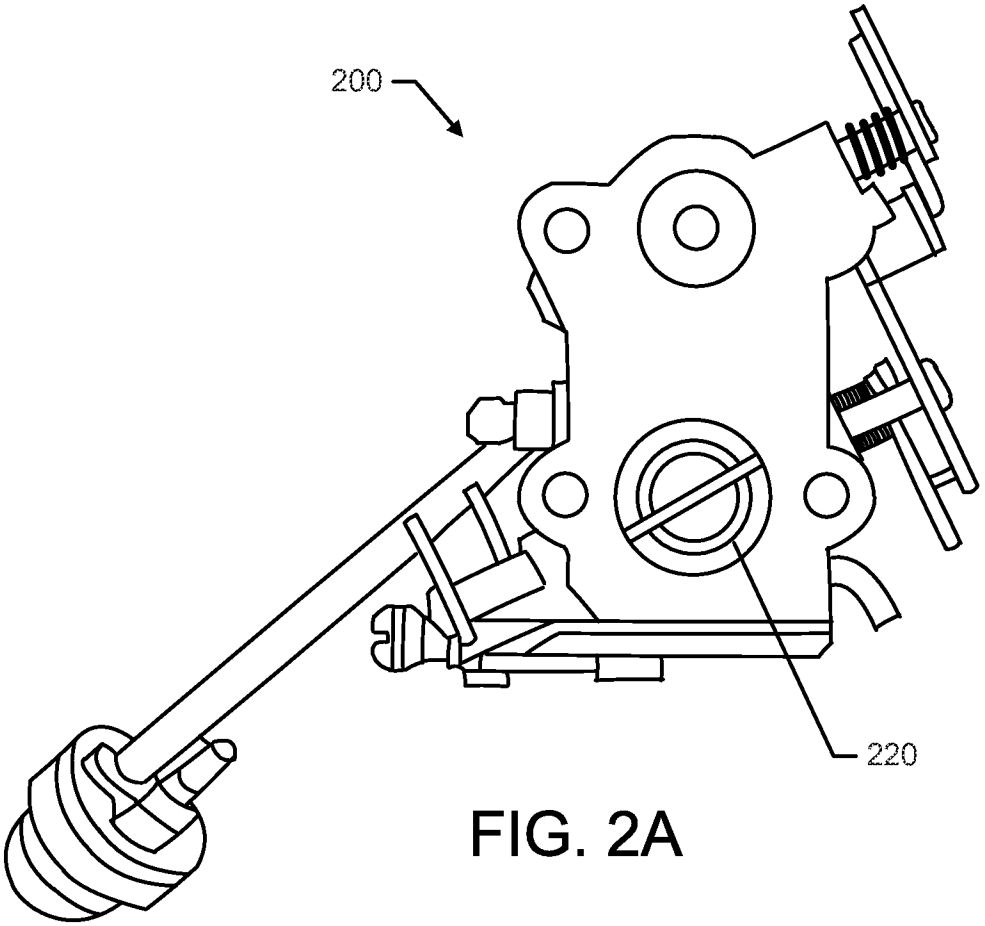

In embodiments that employ a carburetor within the fuel supply system, the carburetor typically includes a venturi disposed in an intake passage. As shown in FIG. 2, which includes FIGS. 2A and 2B (where FIG. 2A shows a front view of portions of a carburetor 200 and FIG. 2B illustrates a cross sectional view of the carburetor 200 taken along line A-A in FIG. 2A), a throttle valve 210 may be provided along with a choke valve 220 in the intake passage 230. The choke valve 220 may precede the throttle valve 210 within the intake passage 230 and the throttle valve 210 may remain shut when the engine is idling and may be opened responsive to operation of the trigger 136. Meanwhile, the choke valve 220 is often used to facilitate starting of the engine.

A typical fuel enrichment system that employs a carburetor may utilize the choke valve 220 during the engine start process. The choke valve 220 is used to restrict the flow of air and thereby enrich the fuel-air mixture during engine startup. The choke valve 220 operates to reduce pressure inside the throat of the intake passage 230 so that a greater amount of fuel is pushed into the combustion chamber during startup. Once the engine has started and warmed up, the choke valve 220 can be opened to restore normal carburetor operations. Thus, the choke valve 220 may act as a component of a fuel enrichment system that is temporarily employed to aid engine starting.

The use of the fuel enrichment system may be helpful to facilitate starting and subsequent running of the engine without requiring continued operator interaction to manipulate the position of the choke valve 220 manually during startup attempts. As an example, a series of attempts at full choke may be followed by a series of attempts at half-choke, and this process may be confusing to novice operators. The fuel enrichment system of an example embodiment may provide a single step starting system that automatically resets after startup. Moreover, some example embodiments may further provide for the fuel enrichment system to account for different ambient temperatures as well.

When ambient temperatures are warm, the carburetor of a typical fuel enrichment system tends to operate fairly well. Thus, the fuel enrichment system can be expected to perform relatively well when temperatures are greater than about 40 degrees Fahrenheit. However, as temperatures plunge below about 40 degrees Fahrenheit, cold air rushing through the venturi can "ice" the carburetor and freeze over the main nozzle jet. To address this situation, some example embodiments may provide for different fuel enrichment conditions to be provided for different ambient temperatures during startup. In particular, the operator may be enabled to operate an activation lever 150 (see FIG. 1). The activation lever 150 may be selected by the operator based on the current ambient temperature at the time of startup. Corresponding different fuel enrichment conditions may then be established during startup. After startup, the activation lever 150 may be returned to its normal operating position to stop the process of enhancing the enrichment provided during startup.

In some cases, it may be desirable to have the activation lever 150 be actuated using two independent or distinct motions instead of one. In other words, the activation lever 150 may not be enabled to simply be rotated (i.e., via a single motion). Instead, there may be an "unlock" mechanism provided that is actuated via one motion, and then the activation lever 150 may be operated when unlocked via a second motion to change the position (and operating mode) of the activation lever 150. This may be desirable to ensure that the operator is aware of the fact that the lever is being actuated.

Figure 3:
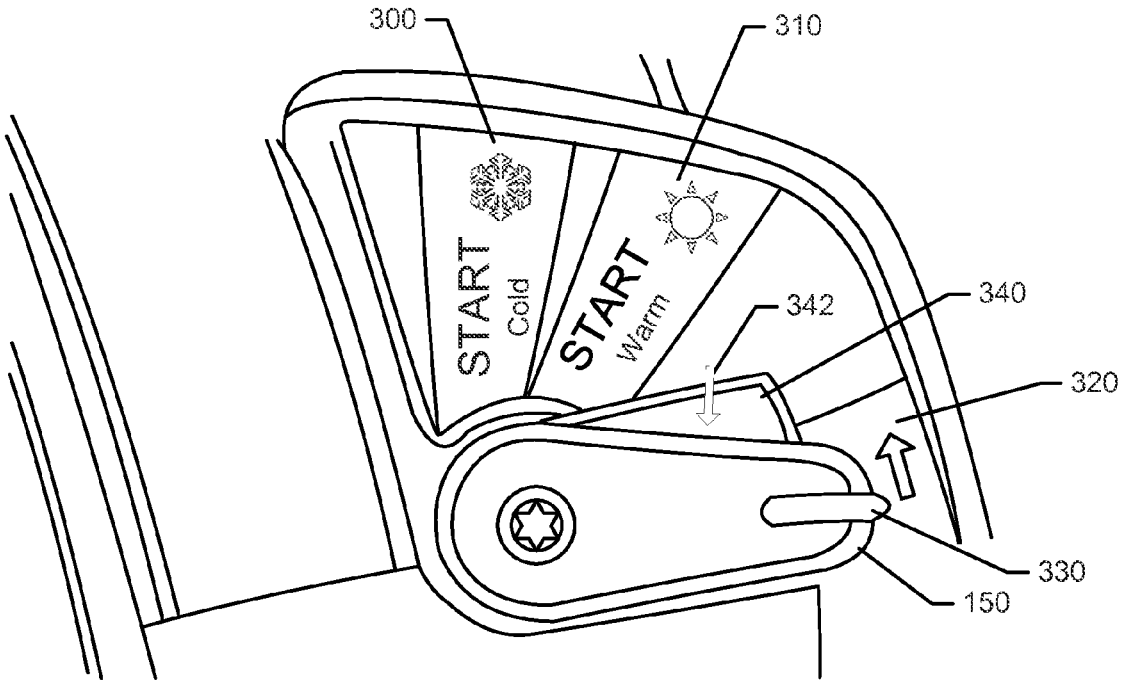
FIG. 3 illustrates a close-up side view of the activation lever in accordance with an example embodiment.

FIG. 3 illustrates a close-up side view of the activation lever 150 in accordance with an example embodiment. As shown in FIGS. 1 and 3, the activation lever 150 may be operably coupled to the chainsaw 100 at a side portion of the housing 110. However, the activation lever 150 could alternatively be disposed at any other suitable portion of the housing 110. The activation lever 150 may be provided such that it rotates between distinct positions that may be marked on a background formed by or on the side of the housing 110. As shown in FIG. 3, a decal, sticker, etched images, visual display, or other visible indicia may be provided on the housing 110 to identify different positions or ranges that correspond to respective different operating modes of the chainsaw 100. In particular, the positions or ranges may identify a cold start range 300, a warm start range 310 and a normal operating range 320. The ranges may be arrayed such that when the activation lever 150 is rotated, a distal end portion thereof lies in alignment with a respective range or points to the currently selected range. The activation lever 150 may include a pointer 330 to facilitate identification of the correspondingly selected range. In the example of FIG. 3, the pointer 330 is within the normal operating range 320.

The activation lever 150 may further include a lockout member 340 that may be required for actuation in order to free the activation lever 150 to be rotated at least out of the normal operating range 320. As such, for example, the lockout member 340 may prevent movement of the activation lever 150 out of the normal operating range 320 unless the lockout member 340 is depressed (i.e., pushed in the direction of arrow 342). If the lockout member 340 is depressed, the activation lever 150 may be rotated into the cold start range 300 or the warm start range 310. In some embodiments, rotation of the activation lever 150 out of the warm start range 310 or the cold start range 300 may be accomplished without depressing the lockout member 340. As such, in some embodiments, the lockout member 340 may operate as one independent motion and the rotation of the activation lever 150 may operate as a second independent motion required to establish fuel enrichment conditions for selection of one of two separate, temperature-dependent startup modes. Moreover, as will be discussed in greater detail below, the activation lever 150 may automatically return to the normal operating range 320 and restore normal operation of the fuel enrichment system after the engine is warmed up and the chainsaw 100 is operated for cutting (e.g., when the throttle (or trigger 136) is actuated).

Figure 5:
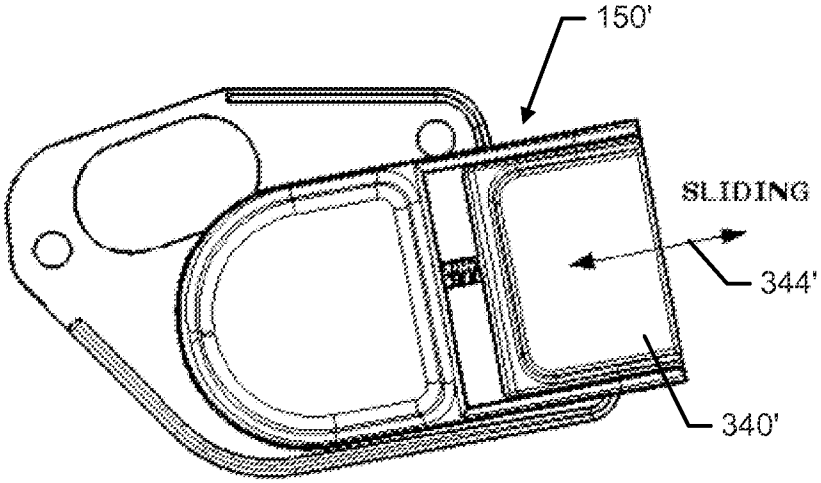
FIG. 5 illustrates a side view of an alternative structure for an activation lever according to an example embodiment.
Figure 4:
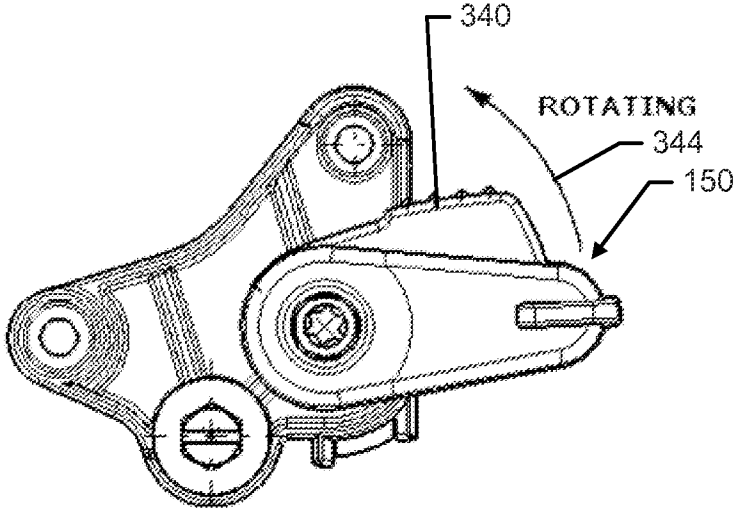
FIG. 4 illustrates a side view of the activation lever in accordance with an example embodiment.

FIG. 4 illustrates a side view of the activation lever 150 to show the direction of rotation 344 that is enabled when the lockout member 340 is depressed. However, it should be appreciated that other structures may be provided for the activation lever 150 to achieve substantially similar functionality. As an example, FIG. 5 is provided to illustrate a side view of an alternative structure for an activation lever 150' according to an example embodiment. The activation lever 150' of FIG. 5 may not rotate between ranges or positions associated with startup and normal running, but may instead have a slide function employed to achieve the same result. The lockout member 340' may be embodied as a member that is pinched or compressed to enable the activation lever 150' to be slid between ranges or positions as indicated by arrow 344'.

In an example embodiment, the cold start range 300 and the warm start range 310 may represent examples of selectable engine startup modes (e.g., first and second fuel enrichment modes, respectively) that may be selected to initiate different startup conditions relative to the fuel enrichment conditions to be created during startup. For example, each mode may correspond to a respective different position of the choke valve 220 of the carburetor 200. In an example embodiment, the choke valve 220 may be positioned such that it is substantially closed when the activation lever 150 is within the first operating range (i.e., the cold start range 300 for a cold ambient temperature) and may be slightly open when the activation lever 150 is within the second operating range (e.g., the warm start range 310 for a warmer ambient temperature).

Figure 6:
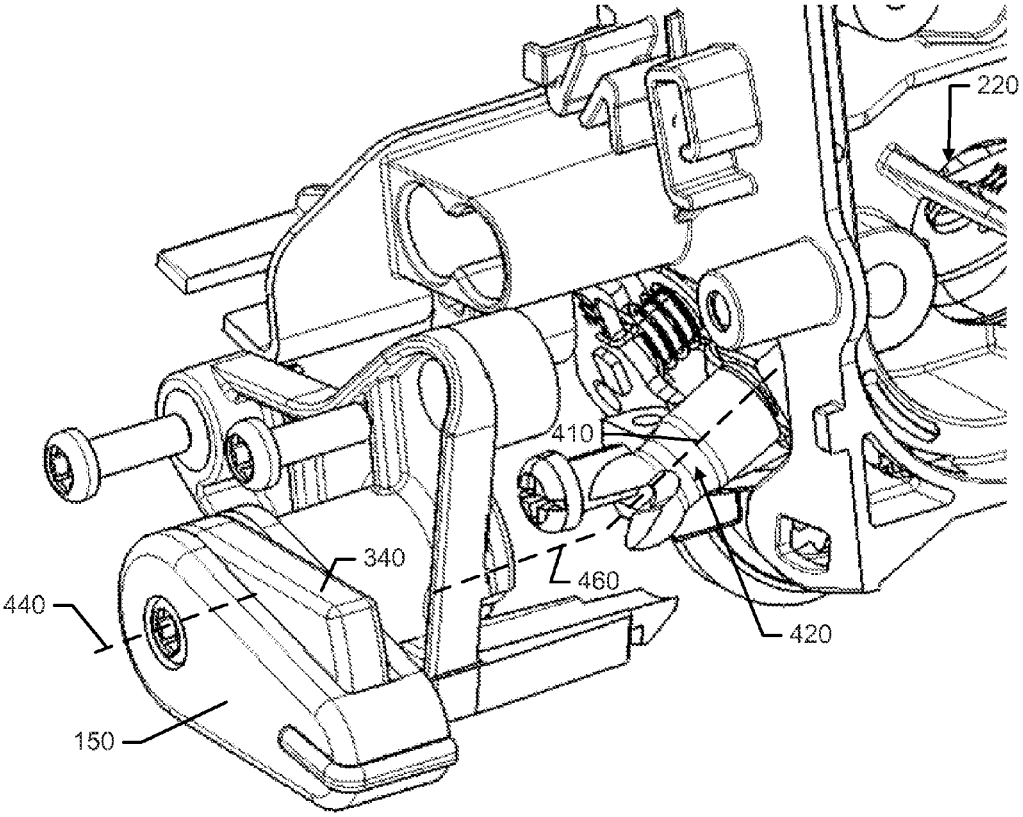
FIG. 6 illustrates a perspective side view of some components used to operate the activation lever in accordance with an example embodiment.
Figure 8:
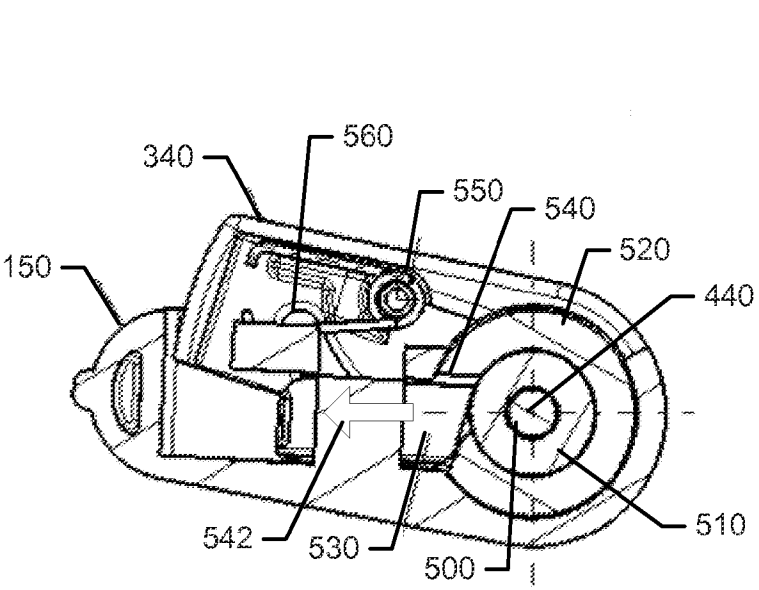
FIG. 8 illustrates a cross section view of components inside the activation lever for a cross section taken along line C-C of FIG. 7 in accordance with an example embodiment.
Figure 7:
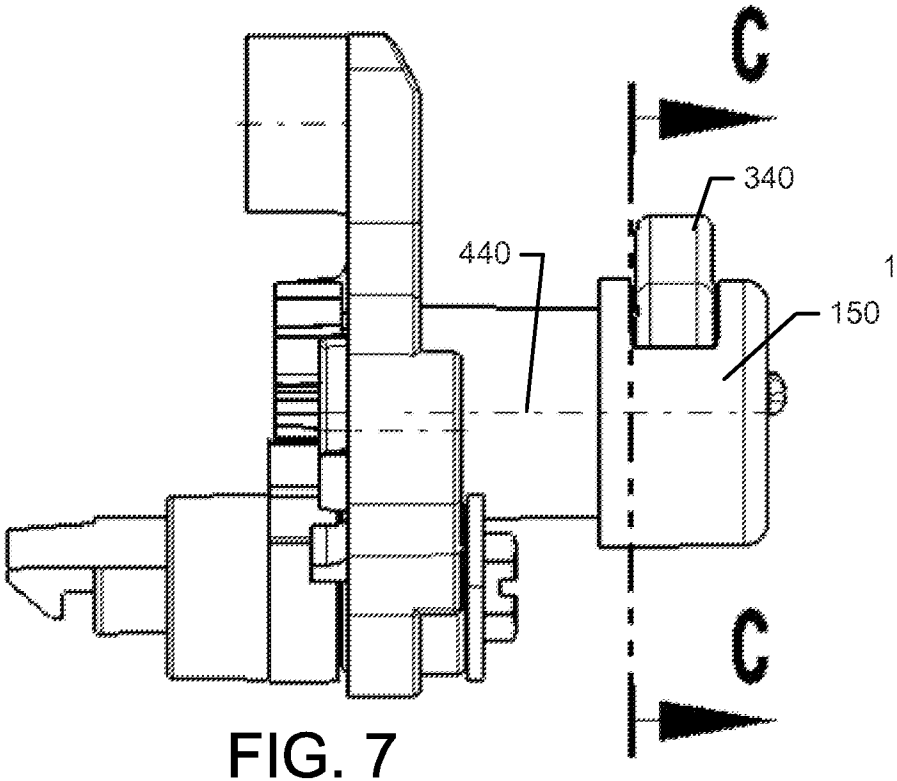
FIG. 7 illustrates a partially isolated view of the activation lever from a front perspective in accordance with an example embodiment.
Figure 10:
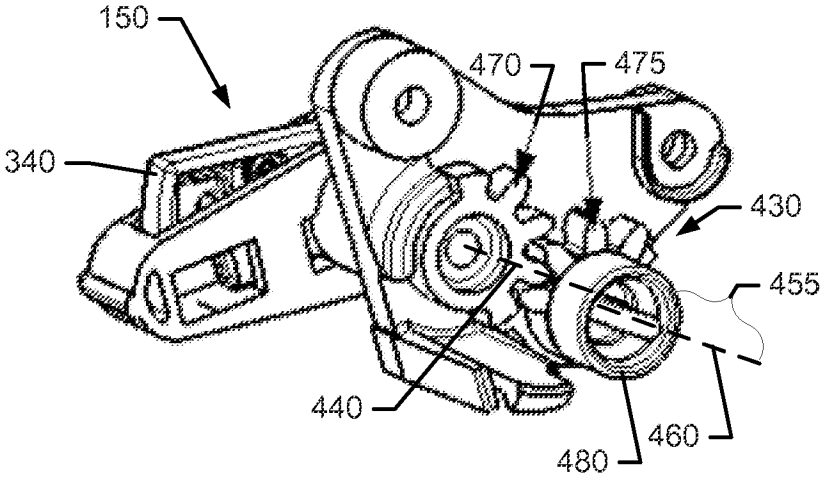
FIG. 10 illustrates a rear perspective view of the activation lever and gear coupler assembly for reversing rotation of the activation lever relative to the shaft of the choke valve in accordance with an example embodiment.
Figure 9:
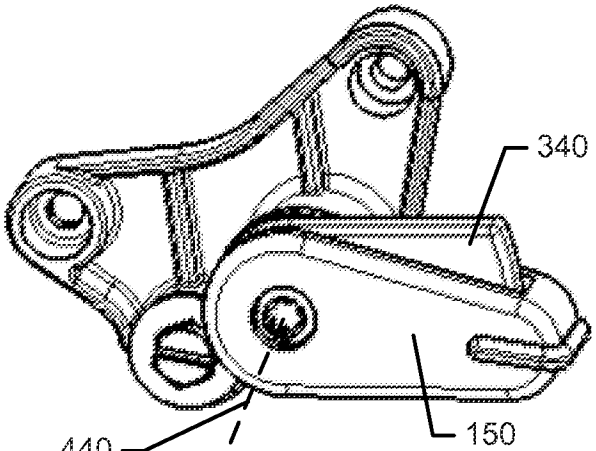
FIG. 9 illustrates a front perspective isolated view of the activation lever and a gear coupler assembly for reversing rotation of the activation lever relative to the shaft of the choke valve in accordance with an example embodiment.
Figure 11:
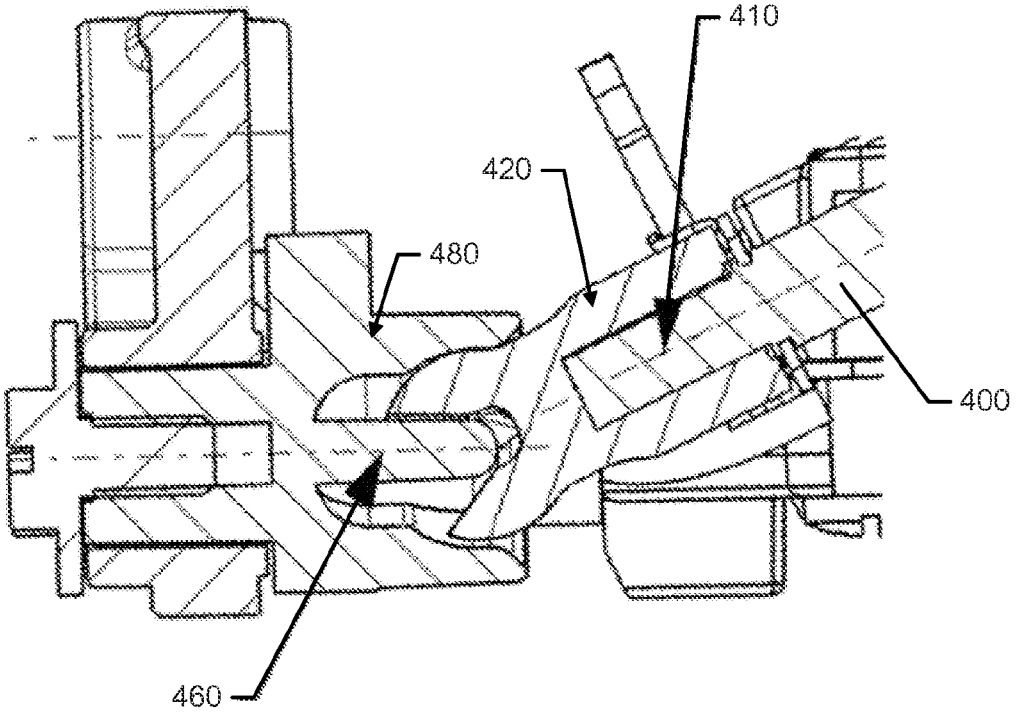
FIG. 11 illustrates a cross section view taken along the axis of the shaft of the choke valve in accordance with an example embodiment.

FIG. 6 illustrates a perspective side view of some components used to operate the activation lever 150 in accordance with an example embodiment. FIG. 7 illustrates a partially isolated view of the activation lever 150 from a front perspective in accordance with an example embodiment. FIG. 8 illustrates a cross section view of components inside the activation lever 150 for a cross section taken along line C-C of FIG. 7. FIG. 9 illustrates a front perspective isolated view of the activation lever 150 and a gear coupler assembly for reversing rotation of the activation lever 150 relative to the shaft of the choke valve, and FIG. 10 illustrates a rear perspective view of the same. FIG. 11 illustrates a cross section view taken along the axis of the shaft of the choke valve in accordance with an example embodiment. An example embodiment will now be described in reference primarily to FIGS. 6-11.

The activation lever 150 may be operably coupled to the choke valve 220 to enable the choke valve 220 to be positioned differently for each of the respective different startup modes (e.g., the first fuel enrichment mode and the second fuel enrichment mode). To achieve this operable coupling, some embodiments may provide that the choke valve 220 is attached to a rotatable shaft (e.g., choke valve shaft 400). The choke valve shaft 400 may rotate about an axis 410 and may extend from the choke valve 220 to engage a coupler (e.g., carburetor coupler 420) that is operably coupled to the activation lever 150 via a geared assembly 430. Meanwhile, the activation lever 150 and the lockout member 340 may each rotate about a same axis 440. However, the axis 440 about which the activation lever 150 and the lockout member 340 rotate may be offset relative to the axis 410 of the choke valve shaft 400. The offsetting of the axis 410 and the axis 440 may allow the activation lever 150 to be strategically positioned relative to the housing 110. In particular, since the axis 410 intersects a plane of the housing 110 at a portion of the housing 110 that is a relatively far distance from a rear edge portion of the housing, the offset may enable the activation lever 150 to be placed proximate to the rear edge portion 450 (see FIG. 1) of the housing 110. The geared assembly 430 may provide for the offset so that the activation lever 150 overlaps with the rear edge portion 450 and indicia may be placed at the rear edge portion to indicate the mode of operation.

As shown in FIG. 10, the geared assembly 430 may provide for communication of rotational forces associated with turning of the activation lever 150 to the choke valve shaft 400 employing the offset 455 between axis 440 and axis 460 that intersects with the axis 410 about which the choke valve shaft 400 rotates. The axis 440 about which the activation lever 150 and the lockout member 340 rotate may also form the axis for a first gear 470 of the geared assembly 430. The first gear 470 may have teeth that engage a second gear 475 such that rotation of the first gear 470 in one direction causes rotation of the second gear 475 in the opposite direction. The rotation of the second gear 475 may then be coupled to the carburetor coupler 420 via a gear coupler 480 that is directly coupled to the second gear 475 to rotate therewith. The coupling of the carburetor coupler 420 with the gear coupler 480 (as shown in FIG. 11) may cause rotation of the choke valve shaft 400 in the same direction as the rotation of the second gear 475. Accordingly, when the activation lever 150 is moved in one direction, the choke valve shaft 400 may rotate in the opposite direction to operate the choke valve 220. The gear coupler 480 and the carburetor coupler 420 may be oriented such that they engage each other and couple rotation about two axes that form an acute angle relative to each other. As such, as shown in FIG. 11, the axis 410 is at an acute angle relative to the axis 460.

In an example embodiment, the activation lever 150 may be locked in the normal operating position unless the lockout member 340 is actuated (e.g., by being depressed). As shown in FIG. 8, the axis 440 of rotation about which both the lockout member 340 and the activation lever 150 rotate may be defined by a a fastener 500 that holds lever 150 to gear shaft 510 that is aligned with the axis 440. The gear shaft 510 may be a portion of the activation lever 150 and the lockout member 340 may include a hub (not shown) that engages the fastener 500 to permit the lockout member 340 to rotate about the gear shaft 510. A hub 520 may be a portion of the housing 110 (or otherwise be fixed relative to the housing 110) and the fastener 500 and gear shaft 510 may be enabled to rotate within the hub 520 when the lockout member 340 is actuated.

In an example embodiment, the lockout member 340 may be in communication with a slide lock 530. The slide lock 530 may be biased to engage or be inserted into a receiver 540 disposed in the hub 520 unless the lockout member 340 is depressed. As such, when the lockout member 340 is not depressed (e.g., in a rest position), the slide lock 530 may be inserted into the receiver 540 and prevent rotation of the activation lever 150. However, when the lockout member 340 is depressed, the slide lock 340 may be extracted from the receiver 540 (in the direction of arrow 542 so that the activation lever 150 is permitted to rotate about the axis 440 to move the activation lever 150 to the cold start range 300 or the warm start range 310 and correspondingly rotate the choke valve 220 to the first or second fuel enrichment mode.

In some cases, the lockout member 340 may further be biased to return to its rest position after it is actuated or depressed. As shown in FIG. 8, the lockout member 340 may include a spring 550 or other biasing member. The spring 550 may be disposed between a top casing portion of the lockout member 340 and an internal portion of the activation lever 150 to compress therebetween when the lockout member 340 is depressed. When the operator removes pressure of the top casing portion of the lockout member 340, the compression of the spring 550 may be released to return the lockout member 340 to its rest position. The slide lock 530 may include a protrusion that rides in a shaped channel 560 within the interior of the lockout member 340 so that the slide lock 530 rides along the shaped channel 560 as the slide lock 530 is withdrawn from the receiver 540.

In an example embodiment, the activation lever 150 may be configured to stay in position with the cold start range 300 or the warm start range 310 after repositioning until the trigger 136 is pressed. Thus, for example, the activation lever 150 may be configured to be biased to return to the normal operating range 320 (or position) from either the first fuel enrichment mode or the second fuel enrichment mode responsive to actuation of the trigger 136.

In some embodiments, the combustion engine may be configured to operate in a first idle mode (e.g., fast idle from 5000 to 6000 RPM) while the activation lever 150 is positioned to correlate to the first fuel enrichment mode or the second fuel enrichment mode and startup is completed. Thus, for example, when the engine is initially started and cold, regardless of the ambient temperature and corresponding fuel enrichment mode, a relatively fast idle may be utilized until the engine warms up. Then, when the trigger 136 is actuated so that the throttle valve 210 is operated, the setting for fast idle may be removed as the activation lever 150 is returned to the normal operating range 320. If the trigger 136 is thereafter released, the engine may operate in a second idle mode (e.g., a regular idle mode with idle speed around 3000 RPM) while the activation lever is positioned in the normal operating range 320.

In some embodiments, the chainsaw 100 may further include an ignition system 600 (represented by dashed lines in FIG. 1 since it is an internal system) that may include an electronic control unit (ECU) or an ignition module. A component such as the ignition module may be used to control the ignition timing associated with application of sparks to ignite fluid in the combustion chamber of the engine. In some cases, the ignition system can be configured to enhance starting by changing the ignition timing point to either provide more or less power at strategically useful times. This can help ensure that when the engine is started, it can stay running as it goes through a warm-up period. Fuel delivery provided via the carburetor 200 is a fixed metering system. Thus, adjustments to the ignition timing can provide an adjustable parameter to control either advancing or delaying timing of ignition for achievement of desired performance criteria and may facilitate idling during warm-up. During startup in particular, the fuel enrichment system will provide an over-rich state. Thus, ignition can be advanced in order to make more power, which may correct the effects of the over-rich condition. The ignition module may be configured to employ an ignition logic program that makes adjustments to timing based on speed changes only in a defined idle starting speed range (e.g., 500 to 4500 RPM).

Example embodiments may therefore provide a relatively easy way to start and operate a power tool (e.g., the chainsaw). In this regard, a single component (e.g., the activation lever) may be operated (using a two-step positioning process) to control a starting system that provides improved starting capabilities over different ambient temperature ranges and also automatically resets itself to normal operating conditions after the startup is complete and the engine is warmed up or otherwise operational for employment of its working assembly (as indicated by engaging the trigger or throttle).

A hand-held power tool (e.g., a chainsaw or other tool) of an example embodiment may include a housing, a power unit disposed within the housing and configured to operate at least in part in response to actuation of a trigger, a working assembly powered responsive to operation of the power unit, and an activation lever having an integrated lockout member. The activation lever may selectively engage a first fuel enrichment mode associated with startup of the power unit in a first range of ambient temperatures and a second fuel enrichment mode associated with startup of the power unit in a second range of ambient temperatures based on a position of the activation lever. Selective engagement of the first fuel enrichment mode or the second fuel enrichment mode may be enabled responsive to actuation of at least the lockout member and positioning of the activation lever.

The power tool (or fuel enrichment system) of some embodiments may include additional features that may be optionally added either alone or in combination with each other. For example, in some embodiments, (1) the power unit may be an internal combustion engine and the first and second fuel enrichment modes may each correspond to respective different positions of a choke valve of a carburetor. In some cases, (2) the activation lever may be operably coupled to the choke valve to position the choke valve relatively more open in the second fuel enrichment mode than a position of the choke valve in the first fuel enrichment mode. In an example embodiment, (3) the activation lever and the lockout member may each rotate about a same axis. In some embodiments, (4) the choke valve may be positioned via rotation of a choke shaft, and an axis of rotation of the choke shaft may be offset from an axis of rotation of the activation lever. In some cases, (5) the choke valve may be positioned via rotation of a choke shaft, and the choke shaft may be operable in a direction opposite the direction of rotation of the activation lever in response to positioning of the activation lever. In an example embodiment, (6) a geared coupler may be provided to offset an axis of rotation of the choke shaft from an axis of rotation of the activation lever such that the activation lever substantially overlaps with an edge portion of the housing.

In some embodiments, any or all of the items (1) to (6) above may be provided individually or in combination with each other and the lockout member may be biased to return to a rest position after release of the lockout member. Additionally or alternatively, any or all of the items (1) to (6) above may be provided individually or in combination with each other and the activation lever may be biased to return to a normal operating position from either the first fuel enrichment mode or the second fuel enrichment mode responsive to actuation of the trigger. Additionally or alternatively, any or all of the items (1) to (6) above may be provided individually or in combination with each other and the combustion engine may be configured to operate in a first idle mode while the activation lever is positioned in the first fuel enrichment mode or the second fuel enrichment mode and may be configured to operate in a second idle mode when the activation lever is positioned in the normal operating position. Additionally or alternatively, any or all of the items (1) to (6) above may be provided individually or in combination with each other and the tool may further include an ignition module configured to vary ignition timing based on an idle speed range. In any of the situations described above, the power tool may be a chainsaw, another cutting device, or other device that may employ a fuel enrichment system.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A hand-held power tool comprising:

a housing;

a power unit disposed within the housing, the power unit being configured to operate at least in part in response to actuation of a trigger;

a working assembly powered responsive to operation of the power unit, wherein the power unit is an internal combustion engine characterized in that an activation lever having an integrated lockout member is manually operated to selectively engage a first fuel enrichment mode associated with startup of the internal combustion engine in a first range of ambient temperatures and a second fuel enrichment mode associated with startup of the internal combustion engine in a second range of ambient temperatures based on a position of the activation lever, wherein the first and second fuel enrichment modes each correspond to respective different positions of a choke value of a carburetor, wherein selective engagement of the first fuel enrichment mode or the second fuel enrichment mode is enabled responsive to actuation of at least the lockout member and positioning of the activation lever, wherein the choke valve is positioned via rotation of a choke shaft, and wherein the choke shaft is operable in a direction opposite the direction of rotation of the activation lever in response to positioning of the activation lever, and wherein a geared coupler is provided to offset an axis of rotation of the choke shaft from an axis of rotation of the activation lever such that the activation lever substantially overlaps with an edge portion of the housing.

2. The hand-held power tool of claim 1, wherein the activation lever is operably coupled to the choke valve to position the choke valve relatively more open in the second fuel enrichment mode than a position of the choke valve in the first fuel enrichment mode.

3. The hand-held power tool of claim 1, wherein the activation lever and the lockout member each rotate about a same axis.

4. The hand-held power tool of claim 1, wherein the choke valve is positioned via rotation of a choke shaft, and wherein an axis of rotation of the choke shaft is offset from an axis of rotation of the activation lever.

5. The hand-held power tool of claim 1, wherein the lockout member is biased to return to a rest position after release of the lockout member.

6. The hand-held power tool of claim 1, wherein the activation lever is biased to return to a normal operating position from either the first fuel enrichment mode or the second fuel enrichment mode responsive to actuation of the trigger.

7. The hand-held power tool of claim 1, wherein the combustion engine is configured to operate in a first idle mode while the activation lever is positioned in the first fuel enrichment mode or the second fuel enrichment mode and configured to operate in a second idle mode when the activation lever is positioned in the normal operating position.

8. The hand-held power tool of claim 1, further comprising an ignition module configured to vary ignition timing based on an idle speed range.

9. The hand-held power tool of claim 1, wherein the hand-held power tool comprises a chainsaw.

10. A fuel enrichment assembly for a hand-held power tool comprising a housing, a power unit disposed within the housing and configured to operate at least in part in response to actuation of a trigger, wherein the power unit is an internal combustion engine, and a working assembly powered responsive to operation of the internal combustion engine, the fuel enrichment assembly comprising:

a manually operated activation lever; and a lockout member integrated with the activation lever, wherein the activation lever selectively engages a first fuel enrichment mode associated with startup of the internal combustion engine in a first range of ambient temperatures and a second fuel enrichment mode associated with startup of the internal combustion engine in a second range of ambient temperatures based on a position of the activation lever, wherein the first and second fuel enrichment modes each correspond to respective different positions of a choke valve of a carburetor, and wherein selective engagement of the first fuel enrichment mode or the second fuel enrichment mode is enabled responsive to actuation of at least the lockout member and positioning of the activation lever, wherein the choke valve is positioned via rotation of a choke shaft, and wherein the choke shaft is operable in a direction opposite the direction of rotation of the activation lever in response to positioning of the activation lever, and wherein a geared coupler is provided to offset an axis of rotation of the choke shaft from an axis of rotation of the activation lever such that the activation lever substantially overlaps with an edge portion of the housing.

11. The fuel enrichment assembly of claim 10, wherein the activation lever is operably coupled to the choke valve to position the choke valve relatively more open in the second fuel enrichment mode than a position of the choke valve in the first fuel enrichment mode.

12. The fuel enrichment assembly of claim 10, wherein the activation lever and the lockout member each rotate about a same axis.

13. The fuel enrichment assembly of claim 10, wherein the choke valve is positioned via rotation of a choke shaft, and wherein an axis of rotation of the choke shaft is offset from an axis of rotation of the activation lever.

14. The fuel enrichment assembly of claim 10, wherein the lockout member is biased to return to a rest position after release of the lockout member.

15. The fuel enrichment assembly of claim 10, wherein the activation lever is biased to return to a normal operating position from either the first fuel enrichment mode or the second fuel enrichment mode responsive to actuation of the trigger.

16. The fuel enrichment assembly of claim 10, wherein the combustion engine is configured to operate in a first idle mode while the activation lever is positioned in the first fuel enrichment mode or the second fuel enrichment mode and configured to operate in a second idle mode when the activation lever is positioned in the normal operating position.

17. The fuel enrichment assembly of claim 10, further comprising an ignition module configured to vary ignition timing based on an idle speed range.

* * * * *